US009206988B2

(12) United States Patent
Wiedenmann

(10) Patent No.: US 9,206,988 B2
(45) Date of Patent: Dec. 8, 2015

(54) COOKER

(75) Inventor: Reinhard Wiedenmann, Weingarten (DE)

(73) Assignee: BSH Hausgeraete GmbH, Munich (DE)

( * ) Notice: Subject to any disclaimer, the term of this patent is extended or adjusted under 35 U.S.C. 154(b) by 173 days.

(21) Appl. No.: 13/583,945

(22) PCT Filed: Feb. 23, 2011

(86) PCT No.: PCT/EP2011/052672

§ 371 (c)(1), (2), (4) Date: Sep. 11, 2012

(87) PCT Pub. No.: WO2011/117037

PCT Pub. Date: Sep. 29, 2011

(65) Prior Publication Data

US 2013/0003351 A1 Jan. 3, 2013

(30) Foreign Application Priority Data

Mar. 22, 2010 (DE) ..... 10 2010 003 115

(51) Int. Cl.
*F21V 33/00* (2006.01)
*F24C 15/00* (2006.01)

(52) U.S. Cl.
CPC ..... *F24C 15/008* (2013.01)

(58) Field of Classification Search
CPC ..... F25D 27/00; A47F 3/001; F21Y 2101/02; F21V 19/04; A47J 37/043; A47J 31/02; F24C 15/04; F24C 15/008; F21S 13/00
USPC ..... 362/92, 125–126, 253–254; 99/341, 99/285; 126/200, 213
See application file for complete search history.

(56) References Cited

U.S. PATENT DOCUMENTS

| | | | | |
|---|---|---|---|---|
| 7,252,402 | B2 * | 8/2007 | Gotz et al. | 362/94 |
| 2006/0049188 | A1 * | 3/2006 | Gramlich et al. | 219/723 |
| 2008/0179317 | A1 * | 7/2008 | Beausse | 219/680 |
| 2009/0071463 | A1 * | 3/2009 | Ebert et al. | 126/273 R |

FOREIGN PATENT DOCUMENTS

| | | | |
|---|---|---|---|
| DE | 10204612 | A1 | 5/2003 |
| EP | 1995522 | A1 * | 11/2008 |
| EP | 2063188 | A2 * | 5/2009 |

OTHER PUBLICATIONS

International Search Report PCT/EP2011/052672.

* cited by examiner

*Primary Examiner* — Diane Lee
*Assistant Examiner* — Naomi M Wolford
(74) *Attorney, Agent, or Firm* — James E. Howard; Andre Pallapies

(57) ABSTRACT

A cooking appliance includes a muffle having walls to delimit a cooking chamber. The muffle has a front face provided with a loading opening which is delimited peripherally by a front edge of the muffle. A lighting apparatus has at least one light source which is configured to light up the cooking chamber and/or to display information. The at least one light source is disposed outside the cooking chamber and in front of the front edge of the muffle when the cooking appliance is viewed from the front.

17 Claims, 2 Drawing Sheets

COOKER

BACKGROUND OF THE INVENTION

The invention relates to a cooking appliance having a cooking chamber, which is delimited by walls of a muffle and has a loading opening on the front face, said loading opening being delimited peripherally by a front edge of the muffle. The cooking appliance also comprises a lighting apparatus with at least one light source.

Cooking appliances, such as ovens, are known, which have different slide-in levels in the cooking chamber for baking sheets, racks and the like. Such food holders can then be inserted at the different slide-in levels and the food placed therein can be prepared. In this context cooking appliances are also known, in which said slide-in levels and the cooking chamber as a whole can be illuminated by a lighting apparatus.

An oven with a corresponding lighting apparatus for illuminating a cooking chamber is known from DE 10 2005 044 347 A1. In this the light sources, which are configured as light-emitting diodes, are disposed outside the cooking chamber. To this end they are integrated in a side wall of the muffle, with a separating wall being disposed for this purpose between the light source and the muffle chamber. Insulating material is also disposed between the separating wall and the light source.

BRIEF SUMMARY OF THE INVENTION

The object of the present invention is to create a cooking appliance, with which a light source of a lighting apparatus can be positioned outside the cooking chamber in an improved manner.

An inventive cooking appliance comprises a cooking chamber in which food can be prepared. The cooking chamber is delimited by walls of a muffle. The muffle has a loading opening on the front face. The loading opening is delimited peripherally by a front edge of the muffle. The cooking appliance also comprises a lighting apparatus with at least one light source. The at least one light source is configured to light up the cooking chamber and/or to display information and is positioned outside the cooking chamber. When the cooking appliance is viewed from the front, said light source is disposed in front of the front edge of the muffle. This light source position is particularly exposed in a space-saving embodiment. In particular said position is also particularly non-critical compared with other positions in respect of thermal loading of the light source. Additional measures such as insulating materials or the like are not required here. In addition it can be positioned here in such a manner that it has particular protection from mechanical influences. In particular it enables a particularly appropriate presentation of information in such a manner that a user can see it easily and quickly in addition to the illumination of the cooking chamber.

Provision is particularly preferably made for the at least one light source to be disposed between the front edge of the muffle and, when the appliance is viewed from the front, to be disposed in front of the decorative strip of the cooking appliance disposed on the front edge. This is particularly advantageous, as it means that the space that is present anyway, between the front edge or front flange of the muffle and the decorative strip, is utilized correspondingly. A support disposed therein to accommodate the light source is in particular provided. This allows particularly mechanically stable positioning.

Provision can be made for the light source, when the appliance is viewed from the front, to be disposed in such a manner that it is concealed by the decorative strip. This results in an advantageous embodiment in that a manner of impact protection for the light source is ensured when the food holder is introduced. Damage can thus be avoided.

The support is preferably a metal part, which is configured in the manner of a strip or as a hollow profile. As a result the at least one light source can also be let into the support, with the result that it is disposed with even greater protection and in an improved manner in respect of space saving. The thermal impact on the light source can be reduced further as a result.

The light source is disposed in particular on a support connecting the front edge of the muffle and the decorative strip. In such an embodiment the support functions in the manner of a mechanical connecting element between said components and is thus configured to be multifunctional. In addition to accommodating the light source, it is also provided as a mechanical stabilizing and connecting part.

Provision can also be made for the support also to accommodate at least one reflector to reflect the light from the light source into the cooking chamber and/or into a door closing off the cooking chamber. This can further improve the light distribution and the optical information presentation.

It is particularly advantageous if the light source is disposed in such a manner that, when a door closing off the cooking chamber is in a closed state, it is disposed at the side of the door. This requires additional space in respect of the depth of the cooking appliance. In particular it ensures the opening and closing of the door without restriction and the directly adjacent light source is not adversely affected in respect of mechanical strain or wear as a result.

In particular when the cooking appliance is viewed from the front, the light source is preferably disposed relative to the closed door in such a manner that in the depthways direction of the door and thus in respect of its thickness the light source is disposed laterally adjacent to the door within the depthways dimensions of said door. Since in this context seals are also generally configured on the front muffle flange or front edge, sealing the cooking chamber when the door is closed, the light source is thus also configured in front of said seal in practical terms. Because a door of a cooking chamber is generally configured from a number of plates disposed one behind the other, made in particular of a glass material, this also provides thermal insulation from the outside. This specific positioning of the light source also allows corresponding thermal insulation to be achieved due to the construction of the door, which according to one advantageous embodiment is likewise configured from at least two glass door plates in the form of an inner door pane and an outer door pane.

Provision is preferably made for the light source to be covered by the depth of the door when the door is in the closed state and for illumination of the cooking chamber to be prevented. With such an embodiment provision is preferably made for the cooking chamber to have a further lighting apparatus, which is provided to illuminate the cooking chamber and in particular individual slide-in levels when the door is in the closed state.

However provision can advantageously be made for the door to have a light-reflecting surface and for the light from the light source to be able to be directed into the cooking chamber to illuminate it by way of the reflecting surface when the door is in the closed state. A particularly specified advantageous embodiment is achieved here, in which this specifically disposed light source can also be used to illuminate the cooking chamber even when the door is closed.

The reflecting surface is preferably a mirror disposed between an inner door pane and an outer door pane.

The lighting apparatus preferably comprises at least two light sources, which are disposed one below the other in such a manner that, when the door of the cooking appliance is open at least, they are configured respectively to illuminate and/or display an assigned cooking chamber level and therefore a slide-in level. In particular a light source, when viewed as it were in a vertical direction, is disposed in each instance at the height at which the slide-in level is also positioned at its height level.

Provision can advantageously be made for the first light source to be configured to generate light in a first spectral range visible to humans and the at least second light source to generate light in a second spectral range visible to humans that is different from the first. Such an embodiment allows individual slide-in levels to be illuminated in different colors in a simple manner that can be identified at any time by a user. When a user is further away from the cooking appliance, he/she can also identify easily and quickly at all times which slide-in level is illuminated and in some instances correspondingly in use.

A light source is preferably disposed in such a manner that, when the door is open, its light cone is directed at least partially forward and downward. The light cone is therefore also directed forward out of the cooking appliance in a defined and specific manner. Partially removed or partially inserted food holders can thus also be lit up completely.

When a food holder is projecting partially forward out of the cooking chamber, the light cone is preferably oriented to illuminate the top face of the projecting part of the food holder.

The at least one light source is preferably disposed in a movable manner and the light cone can be pivoted as a function of the opening of the door and/or the at least partial removal of the food holder from the cooking chamber. This can be detected by sensors and controlled by a control unit. This allows very precise lighting that is appropriate to requirements.

Provision can preferably also be made, in addition to a light source for lighting up the cooking chamber and/or for displaying information, for at least one further light source to be disposed adjacent to the first light source, the light cone of the further light source being directed at least partially forward and downward when the door is open and the further light source being able to be activated when the door is opened and/or when the food holder is removed from the cooking chamber. Therefore at least two light sources are configured adjacent to one another, so that they are disposed practically at one level. This can be achieved for example by means of an array of light-emitting diodes. When the baking sheet is pulled out for example, the further light source can be switched on and can also light up the partially removed baking sheet on the outside.

The light source is in particular a light-emitting diode. These are particularly intense and can be operated in an energy-efficient manner as well as being very compact and small. However since such light-emitting diodes are relatively heat-sensitive, an inventive arrangement or an advantageous embodiment is particularly suited to this type of light source.

Further features of the invention will emerge from the claims, the figures and the description of the figures. The features and feature combinations cited above in the description and the features and feature combinations cited below in the description of the figures and/or simply shown in the figures can be used not only in the respectively cited combination but also in other combinations or alone, without departing from the scope of the invention.

BRIEF DESCRIPTION OF THE DRAWING

Exemplary embodiments of the invention are described in more detail below with reference to schematic drawings, in which.

DETAILED DESCRIPTION OF EXEMPLARY EMBODIMENTS OF THE PRESENT INVENTION

Figure 1:
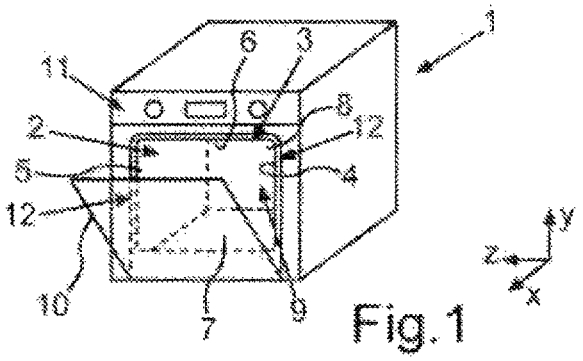
FIG. 1 shows a schematic perspective view of an exemplary embodiment of an inventive cooking appliance.

Identical elements or elements of identical function are shown with the same reference characters in the figures.

FIG. 1 shows a simplified perspective view of a cooking appliance in the form of an oven 1. The oven 1 comprises a cooking chamber 2, into which food can be introduced for preparation purposes. The cooking chamber 2 is delimited by a muffle 3, which comprises corresponding side walls 4 and 5, a top 6, a bottom 7 and a rear wall 8. A loading opening 9 is configured on the front face and can be closed off by a door 10. In the illustrated embodiment the door 10 is hinged at the bottom and can be pivoted about a horizontal axis. Provision can also be made for the door 10 to be hinged at the side and able to be pivoted about a vertical axis.

The oven 1 also comprises an operating facility 11, which is disposed on the front face only by way of example. The operating facility 11 can have one or more operating elements and a display unit. The oven can also have cooking zones (not shown), on which food preparation containers such as pots and pans and the like can be positioned.

The oven 1 also comprises a lighting facility 12, which is configured to illuminate the cooking chamber 2 and/or to display information for a user.

Figure 2:
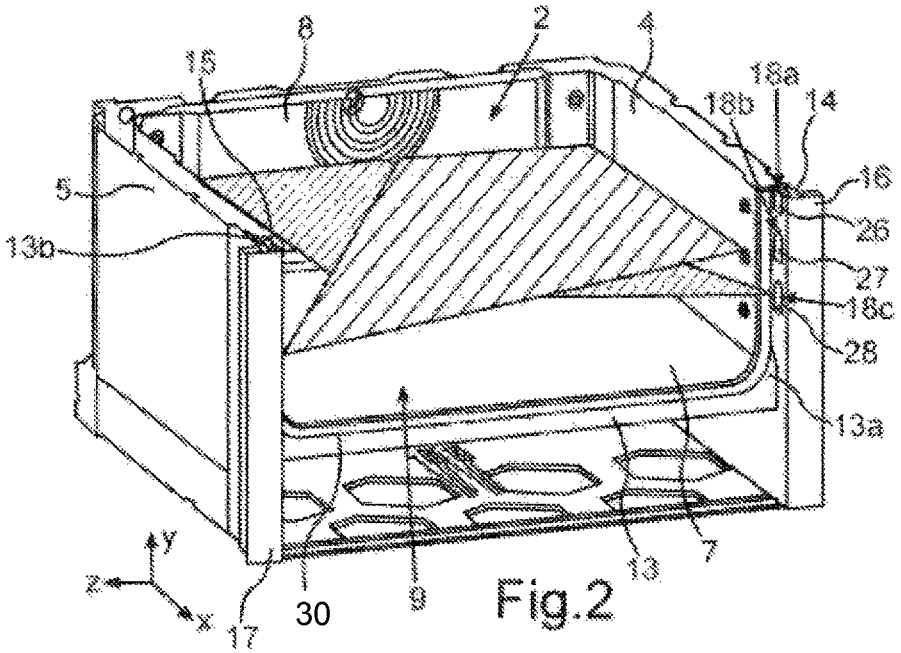
FIG. 2 shows a perspective view of subcomponents of an exemplary embodiment of an inventive cooking appliance.

FIG. 2 shows a perspective view of some components of the oven 1, a horizontal section also being configured in the x-z plane.

The door 10 is not shown in the diagram in FIG. 2. The muffle 3 has a front edge 13 or muffle flange on the front face and at the periphery to delimit the loading opening 9. A peripheral seal 30 is configured on this front edge 13. A support 14 and 15 is disposed respectively toward the front and therefore in the x-direction in front of the front edge 13 in a first vertical region 13*a* of the front edge 13 and in front adjoining a second vertical segment 13*b*of the front edge 13.

A decorative strip 16 and 17 is disposed in turn as an extension in the x-direction in front of the supports 14 and 15.

When the oven 1 is viewed from the front therefore, the decorative strip 16 is disposed directly in front of the support 14 and this is disposed in front of the vertical segment 13*a* of the front edge 13. The same applies to the arrangement of the support 15 in respect of the decorative strip 17 and the vertical segment 13*b*.

The support 14 is connected in particular to the segment 13*a* on the one side and to the decorative strip 16 on the other side. The same applies to the support 15 in respect of the connection to the decorative strip 17 and the segment 13*b*.

Disposed in the support 14 are a number of light sources 18*a*, 18*b* and 18*c*. These are configured as light-emitting diodes. The light sources 18*a* to 18*c* are thus disposed outside the cooking chamber 2 and are thus positioned between the decorative strip 16 and the segment 13*a*, extending the front face in front of the segment 13*a*. Corresponding light sources are also disposed correspondingly in the support 15. The light sources 18*a* to 18*c* are configured to illuminate the cooking chamber 2 and in particular to illuminate an assigned slide-in level in each instance and to display information. In particular they are positioned so that, when the oven 1 is viewed from the front, they are disposed in such a manner that they are concealed by the decorative strips 16 and 17.

In the exemplary embodiment the supports 14 and 15 are embodied as long profiles configured as hollow at least in parts. They are configured both to accommodate the light sources 18*a* to 18*c* and also as parts to accommodate reflectors. Thus for example the light from the light source 18*a* is configured by way of a reflector disposed in the support 14 in the direction of the cooking chamber 2 and in particular the slide-in level assigned to said light source 18*a* and provided for specific illumination.

The light cone for illuminating a specific slide-in level in the cooking chamber 2 is shown schematically by way of example for the light source 18*c*. A further light cone of a light source opposite on the support 15 is similarly outlined.

Figure 3:
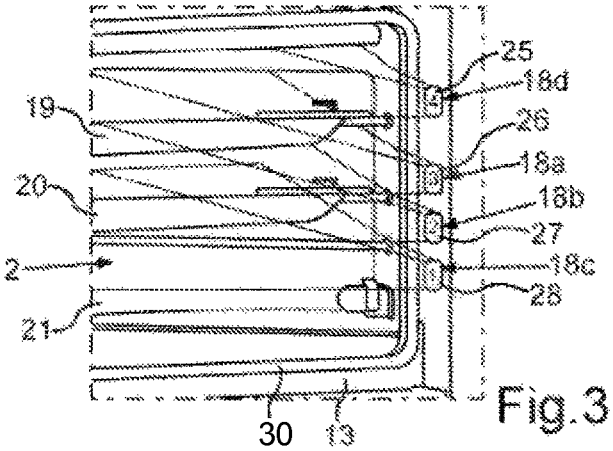
FIG. 3 shows a partial section through a cooking appliance when viewed from the front according to a first specific operating mode.

FIG. 3 shows a front view of a partial section through the oven 1. In this exemplary embodiment three food holders 19, 20 and 21 are introduced at different slide-in levels into the cooking chamber 2. FIG. 3 also shows the further fourth light source 18*d* on this side, which is configured to illuminate the top slide-in level. The food holder 19 is disposed at this top slide-in level.

Provision is made for the light sources 18*a* to 18*d* to be configured to generate specific light colors. In particular provision is made for example for at least one of the light sources 18*a* to 18*d* to be configured to generate light in a spectral range visible to humans, which is different from a spectral range of one or more of the other light sources 18*a* to 18*d*. This allows the individual slide-in levels to be lit in different ways that are also visible to humans.

Provision can also be made according to the diagram in FIG. 3 for the lighting apparatus 12 to be designed so that optical displays can also be produced in the supports 14 and 15 as information for the user. For example, according to the diagram in FIG. 3, a number can be displayed optically, indicating the number of the associated slide-in level.

The light sources 18*a* to 18*d* are thus disposed on the oven 1 in such a manner that they are positioned in the region in front of the oven cavity between the oven cavity flange and the front face of a decorative strip.

According to a first embodiment provision can be made for the cooking chamber 2 and the individual slide-in levels only to be able to be illuminated when the door 10 of the oven 1 is open.

However provision is in particular also made for corresponding illumination of the cooking chamber or the specific slide-in levels to be possible with said light sources 18*a* to 18*d* even when door 10 is closed.

Figure 4:
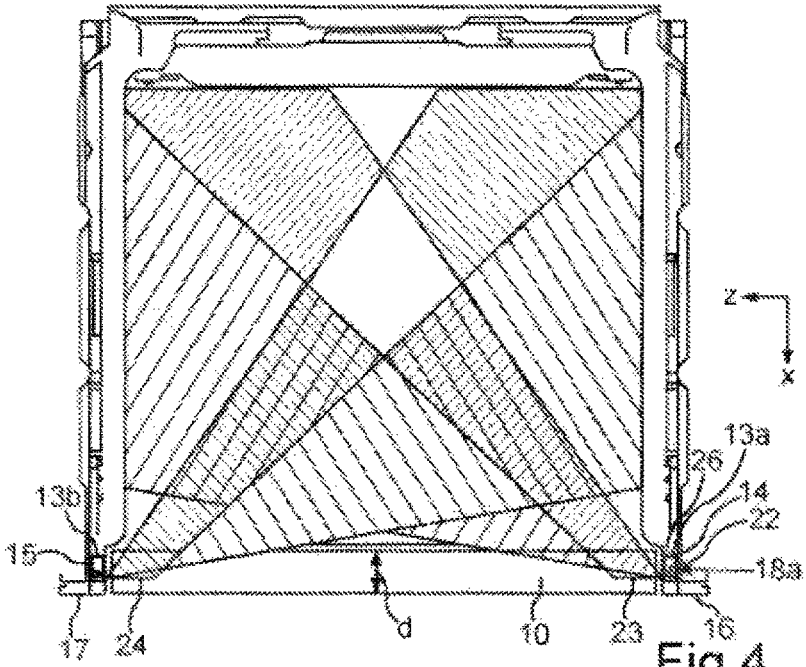
FIG. 4 shows a top view of the view in FIG. 1 with the door of the cooking appliance also closed.

See also FIG. 4 for further explanation in this respect. FIG. 4 shows a top view of the view in FIG. 2 and thus a view in the x-z plane. The door 10 is also shown in the closed state. This diagram again shows the arrangement behind one another in the x-direction of the decorative strip 16 or 17, the support 14 or 15 and the vertical segments 13*a* or 13*d* of the front edge 13.

A reflector 22 is also shown by way of example in the support 14. This serves to reflect the light from the light source 18*a* out of the support 14.

When door 10, which has a thickness d, is closed, the light source 18*a* and the door 10 are positioned in relation to one another in such a manner that the light source 18*a* is disposed at the side of the door 10 and, when viewed in the depthways direction and thus in the x-direction, between the depthways dimensions of the door 10. This means that, when the door 10 is in the closed state, it extends with its thickness d both to the front and to the rear beyond the dimensions of the light source 18*a*. The same applies to the arrangement of the other light sources 18*b* to 18*d* and the light sources in the support 15.

The door 10 comprises at least one inner door pane (not shown in detail) and an outer door pane disposed at a distance therefrom. Further intermediate door panes can also be present.

Disposed in the door 10 adjacent to the light sources 18*a* to 18*d* is a first mirror 23. This serves to reflect the light emitted from the light source 18*a* in the direction of the cooking chamber 2 and in particular to illuminate the third slide-in level. The same is achieved in respect of a lighting means disposed in the support 15 with a mirror 24 disposed on the opposite side.

The light sources 18*a* to 18*d* are preferably covered by light-permeable elements, which are disposed in cutouts in the support 14 and the support 15. These transparent covers are marked in FIG. 2 and FIG. 3 with reference characters 25, 26, 27 and 28.

FIGS. 2 to 4 show embodiments, in which the light sources 18*a* to 18*d* shine into the cooking chamber 2. Provision can also be made for example for the light source 18*a* to be disposed in a pivotable manner and/or for the reflector 22 to be disposed in a pivotable manner. This allows the orientation of the light cone of the light source 18*a* to be changed. Based on the diagram in FIG. 4 provision can then also be made, when door 10 is open and food holder 20 is partially removed from the cooking chamber 2, for the top face of the region of the food holder 20 projecting forward out of the cooking chamber 2 to be able to be lit. Its removal can be detected by a corresponding sensor system and the position of the light cone can be changed by activation by a control unit.

In a further embodiment provision can be made for a further light source (not shown) to be disposed practically at the same height adjacent to the light source 18*a*. This further light source is only activated when the door 10 is opened and the food holder 20 is pulled out of the cooking chamber. It is then preferably disposed in a fixed position and its light cone is permanently set, also lighting up the region of the partially removed food holder 20 projecting forward beyond the cooking chamber 2.

Corresponding embodiments are then also provided for the light sources 18*b* to 18*d*.

REFERENCE CHARACTERS

1 Oven
2 Cooking chamber
3 Muffle
4, 5 Side walls
6 Top
7 Bottom
8 Rear wall
9 Loading opening
10 Door
11 Operating facility
12 Lighting facility

13 Front edge
13*a* First vertical segment
13*b* Second vertical segment
14, 15 Supports
16, 17 Decorative strips
18*a*, 18*b*, 18*c*, 18*d* Light sources
19, 20, 21 Food holders
22 Reflector
23, 24 Mirrors
25, 26, 27, 28 Transparent covers

The invention claimed is:

1. A cooking appliance, comprising:

a muffle having a frame and walls, the walls delimiting a cooking chamber, the muffle having a front face provided with a loading opening which is delimited peripherally by a front edge of the muffle;

a lighting apparatus having a plurality of light sources arranged in a vertical alignment configured to light up the cooking chamber or to display information, the plurality of light sources being disposed in the frame, outside of the cooking chamber and in front of the front edge of the muffle when the cooking appliance is viewed from the front; and a door configured to close off the cooking chamber, wherein the plurality of light sources are disposed at a side of the door, when the door is in a closed state; and wherein the plurality of light sources are disposed outside of a vertical line formed by the side of the door, such that the plurality of light sources and the door are on opposite sides of the vertical line.

2. The cooking appliance of claim 1, further comprising a decorative strip disposed in front of the front edge when viewed from the front, wherein the plurality of light sources are disposed between the front edge of the muffle and the decorative strip.

3. The cooking appliance of claim 2, wherein the plurality of light sources are concealed by the decorative strip when the cooking appliance is viewed from the front.

4. The cooking appliance of claim 2, wherein the plurality of light sources are disposed on a support connected to the front edge of the muffle and the decorative strip.

5. The cooking appliance of claim 4, wherein the support has a reflector to reflect light from the plurality of light sources into the cooking chamber or into a door closing off the cooking chamber.

6. The cooking appliance of claim 1, wherein the plurality of light sources are disposed within depthways dimensions of the door in a depthways direction when the cooking appliance is viewed from the front.

7. The cooking appliance of claim 1, wherein the plurality of light sources are covered by a door depth when the door is in the closed state and illumination of the cooking chamber is prevented.

8. The cooking appliance of claim 1, wherein the door has a light-reflecting surface which, when the door is in the closed state, is able to direct light from the plurality of light sources into the cooking chamber to illuminate the cooking chamber.

9. The cooking appliance of claim 8, wherein the reflecting surface is a minor disposed between an inner door pane and an outer door pane.

10. The cooking appliance of claim 1, further comprising a door configured to close off the cooking chamber, wherein a first one of the plurality of light sources produces a light cone which is directed at least partially forward and downward, when the door is open.

11. The cooking appliance of claim 10, further comprising a food holder movably arranged in the cooking chamber, wherein the light cone is oriented to light up a top face of a projecting part of the food holder, when the food holder is moved partially forward out of the cooking chamber.

12. The cooking appliance of claim 10, wherein the first one of the plurality of light sources is disposed in a movable manner and the light cone is pivotable as a function of an opening of the door or an at least partial removal of a food holder from the cooking chamber.

13. The cooking appliance of claim 10, wherein a second one of the plurality of light sources is disposed adjacent to the first one of the plurality of light sources for lighting up the cooking chamber or for displaying information, the second one of the plurality of light sources producing a light cone which is directed at least partially forward and downward when door is open, the second one of the plurality of light sources being activatable when the door is opened or when a food holder is removed from the cooking chamber.

14. The cooking appliance of claim 1, wherein the plurality of light sources are a plurality of light-emitting diodes.

15. A cooking appliance, comprising:

a muffle having walls to delimit a cooking chamber, said muffle having a front face provided with a loading opening which is delimited peripherally by a front edge of the muffle;

a lighting apparatus having a plurality of light sources configured to light up the cooking chamber or to display information, the plurality of light sources being disposed outside the cooking chamber and in front of the front edge of the muffle when the cooking appliance is viewed from the front; and a door configured to close off the cooking chamber, wherein at least two of the plurality of light sources are disposed one below the other to respectively illuminate or display an assigned cooking chamber level, when the door is open; and wherein the at least two of the plurality of light sources are arranged in a vertical alignment and are disposed in a frame of the cooking appliance, outside the cooking chamber and in front of the front edge of the muffle when the cooking appliance is viewed from the front, and the at least two of the plurality of light sources are disposed at a side of the door, when the door is in a closed state.

16. The cooking appliance of claim 15, wherein one of the plurality of light sources is configured to generate light in a first spectral range visible to humans, and another one of the plurality of light sources is configured to generate light in a second spectral range that is visible to humans and different from the first spectral range.

17. The cooking appliance of claim 15, wherein the at least two light sources are disposed outside of a vertical line formed by the side of the door, such that the at least two light sources are on one side of the vertical line and the door is on an opposite side of the vertical line.

* * * * *